US006840531B2

(12) United States Patent
Gorza et al.

(10) Patent No.: US 6,840,531 B2
(45) Date of Patent: Jan. 11, 2005

(54) DEVICE FOR THE INTERCONNECTION OF A SKI BINDING TO A SKI

(75) Inventors: Roberto Gorza, Feltre (IT); Mirco Battistella, Spresiano (IT)

(73) Assignee: Benetton Group S.p.A., Ponzano Veneto (IT)

( * ) Notice: Subject to any disclaimer, the term of this patent is extended or adjusted under 35 U.S.C. 154(b) by 0 days.

(21) Appl. No.: 10/286,834

(22) Filed: Nov. 4, 2002

(65) Prior Publication Data

US 2003/0085549 A1 May 8, 2003

(30) Foreign Application Priority Data

Nov. 8, 2001 (IT) ..... TV2001A0147

(51) Int. Cl.[7] ..... A63C 9/08
(52) U.S. Cl. ..... 280/617; 280/633; 280/618
(58) Field of Search ..... 280/607, 614, 280/616, 617, 618, 320, 633, 611, 14.22, 608, 620, 602

(56) References Cited

U.S. PATENT DOCUMENTS

| | | | | | |
|---|---|---|---|---|---|
| 4,022,493 | A | | 5/1977 | Weigl et al. | |
| 4,094,529 | A | * | 6/1978 | Nasson | 280/614 |
| 5,040,819 | A | * | 8/1991 | Horn | 280/618 |
| 5,344,176 | A | * | 9/1994 | Trimble | 280/618 |
| 5,344,178 | A | * | 9/1994 | Rohrmoser | 280/617 |
| 5,498,017 | A | * | 3/1996 | Rohrmoser | 280/633 |
| 5,575,496 | A | * | 11/1996 | Luitz et al. | 280/618 |
| 5,758,894 | A | * | 6/1998 | Maggiolo | 280/618 |
| 5,975,555 | A | * | 11/1999 | Lehner et al. | 280/618 |
| 6,217,055 | B1 | * | 4/2001 | Silva | 280/607 |
| 6,471,235 | B1 | * | 10/2002 | Luitz et al. | 280/618 |

FOREIGN PATENT DOCUMENTS

| | | |
|---|---|---|
| FR | 2 756 747 | 6/1998 |
| WO | 00 32284 | 6/2000 |

* cited by examiner

*Primary Examiner*—Hau Phan
(74) *Attorney, Agent, or Firm*—Guido Modiano; Albert Josif; Daniel O'Byrne

(57) ABSTRACT

A device for the interconnection of a ski binding to a ski, comprising a first plate and second plate for interconnecting to a ski respectively a toe unit and a separate heel unit of the ski binding. The first plate and the second plate are movably associated at the bottom respectively to a third plate and a fourth plate that are associated longitudinally to said ski. Additionally, temporary means are provided which are arranged respectively between the first plate and the third plate and between the second plate and the fourth plate.

10 Claims, 6 Drawing Sheets

DEVICE FOR THE INTERCONNECTION OF A SKI BINDING TO A SKI

BACKGROUND OF THE INVENTION

The present invention relates to a device for the interconnection of a ski binding to a ski.

Known types of ski bindings usually comprise a toe unit and a heel unit, which are designed for temporary clamping a ski boot to the ski. Such known types of ski bindings provide an interconnection of the toe unit and the heel unit to the ski through known type mechanical means for example screws. The toe unit and the heel unit are connected to the ski in such a way that the mutual distances between them is proportional to the size of the ski boot being used. This distance is necessarily variable so that it can be adapted to a variation in the ski boot size.

When the ski is loaned to a different user with a different foot size or when the size of the user's foot increases (as for example when the user is a child), it is necessary to make additional holes in the ski in order to allow the interconnection of the toe unit and/or the heel units in a new position, compatible with the new size of the user's foot.

The main drawback of such known type of ski bindings consists in that drilling and shifting the toe and/or the heel unit is not only burdensome and laborious, but necessarily involves a weakening of the structure of the ski and diminution of its reliability.

As a partial remedy of such drawbacks, it is known to manufacture ski bindings designed to allow a partial shifting of the toe unit and/or the heel unit along the longitudinal axis of the ski, thereby allowing the user to perform a variation in the size without necessarily having to make new holes in the ski. Such known types of ski bindings, however, have the drawback of being often structurally complex and consequently very expensive and particularly subject to malfunctioning and possible breaking. Another disadvantage of such known ski bindings consists in that they offer a relatively small adjustment in size, usually suitable for covering two or three sizes at the most. This entails that the ski hire services must necessarily have a wide stock, with skis of various types and lengths, each of which must be fitted with ski bindings having different sizes one from another in order to cover a wide range of possible users. A further shortcoming is that many known types of these ski bindings do not allow an adequate longitudinal flexibility of the ski in the central area, thereby limiting the absorption of the stress given by unevenness of the snowy surface while skiing and therefore increasing the difficulty of practicing the sports.

A further drawback that these known ski bindings is that they require, at the time of purchase, the work of a specialised technician for mounting the ski bindings on the ski and, therefore, they entail a remarkable increase in purchase cost. Yet another shortcoming consists in that it is difficult to remove the ski binding once it is installed, so as to facilitate its transportation in airplanes, trains or cars. Additionally, in many known types of ski bindings it is not possible to invert the position of the toe unit with the heel unit.

As a partial solution to the aforementioned drawbacks, U.S. Ser. No. 10/181,722 by the same Applicant discloses a structure for regulating and fastening a ski binding. This structure comprises a first front plate and a second rear plate providing support for a toe and a heel unit respectively. A third plate is inserted between the first plate and the second plate, provided with a locking device, which may be activated by the user, that is designed to lock temporarily to a mechanism for coordinating the manual, opposed and axial shift of the first plate and the second plate. Such locking device, although ensuring a fast, easy adjustment of the size, suffers the main inconvenience of not allowing optimal longitudinal flexibility of the ski, particularly near the binding proper. Furthermore, this locking device keeps the position of the centre of gravity unaltered with the change in the actual adjustment. This fact, although being advantageous in many cases, proves to be a limitation should the user desire to change way of skiing by moving the centre of gravity either backwards or forwards, as for example in the case of skiing on fresh snow or in a race.

SUMMARY OF THE INVENTION

Therefore, the aim of the present invention is to provide a device for the interconnection of a ski binding to a ski that allows a removable and selective interconnection of the toe unit and the heel unit of said ski binding to the ski to be accomplished simply and very quickly.

Within this aim, another object of the present invention is to provide an interconnection device that allows easy and wide-ranging adjustment of the size of the ski binding to be accomplished.

Another object of the present invention is to provide an interconnection device that ensures an optimal flexibility at the central area of the ski.

A further object of the present invention is to provide an interconnection device that makes the ski binding adaptable to a number of different sizes in order to allow a considerable reduction in the number of skis that must be available in a ski hire service, thereby reducing the costs of investment in the material and at the same time simplifying store management.

Another object of the invention is to provide an interconnection device that allows the user a shift in the centre of gravity, in particular allowing the centre of gravity to be easily moved backwards or forwards.

Another object of the present invention is to provide an interconnection device that allows a reduction in the costs of managing and purchasing skis and bindings by avoiding perforation, positioning and fixing of the ski bindings by a qualified technician in the shop at the time of purchase.

Another object of the invention is to provide an interconnection device that allows a quick, easy interconnection of the ski to the boot in an opposite direction with respect to that commonly used, to allow a second way of using the ski.

Another object of the present invention is to provide an interconnection device that is structurally simple and has low manufacturing costs.

Thus, the present invention provides a device for the interconnection of a ski binding to a ski; as per claim 1.

As will better appear hereinafter, the device according to the present invention allows overcoming the drawbacks of the known solutions of the state of the art, since in particular, it allows to easily and quickly obtain a removable and selective interconnection of the ski binding toe unit and the heel unit to the ski.

BRIEF DESCRIPTION OF THE DRAWINGS

Further characteristics and advantages will become better apparent from the following detailed description of some embodiments of the device according to the present invention, illustrated by way of non-limitative example in the accompanying drawings, wherein.

DESCRIPTION OF THE PREFERRED EMBODIMENTS

Figure 1:
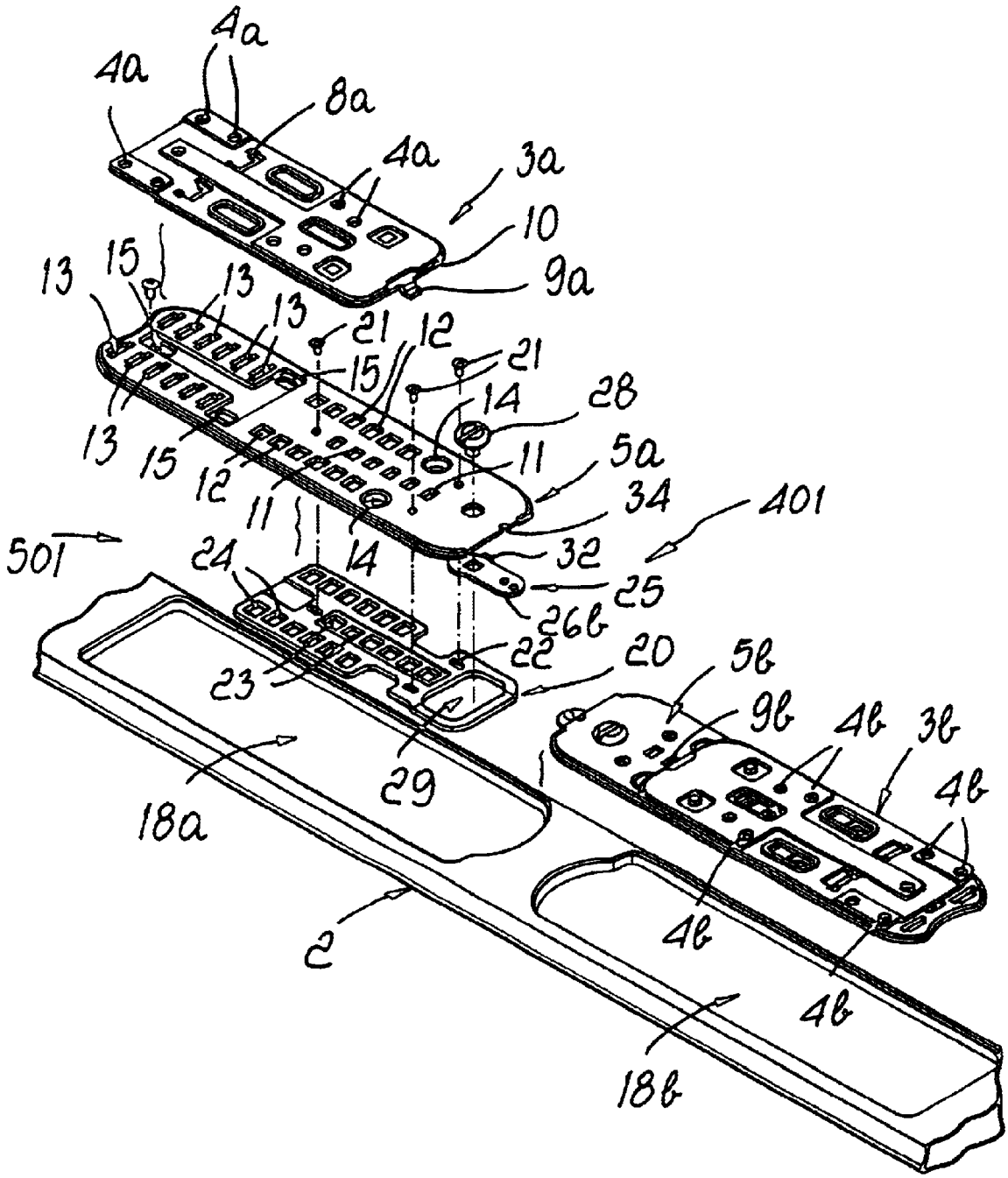
FIG. 1 is a partially exploded view of a first embodiment of the device, according to the present invention.

With reference to the FIGS. 1–7, reference numeral 1 designates a device according to the present invention for the interconnection of a ski binding (not shown) to a ski 2.

The device 1 comprises a first plate 3*a* and a second plate 3*b* that respectively can be connected on the bottom to a toe unit and a separate heel unit of a ski binding (not shown). In particular, a plurality of first threaded holes 4*a* and 4*b* are advantageously arranged on the first plate 3*a* and the second plate 3*b* for interconnection with counter-threaded screws passing transversely the toe and the heel unit of the ski binding, respectively. The first plate 3*a* and the second plate 3*b* are movably associated at the bottom respectively to a third plate 5*a* and a fourth plate 5*b*, which are associated longitudinally to the ski 2. For this aim, temporary interconnection means 301 are arranged respectively between the first plate 3*a* and the third plate 5*a* and between the second plate 3*b* and the fourth plate 5*b*. Preferably, the first plate 3*a* and the third plate 5*a* are arranged longitudinally along the ski 2 in a mirror-like position with respect to the second plate 3*b* and the fourth plate 5*b* in order to ensure the interchangeability between toe unit and the heel unit of the ski binding, thereby allowing the use of the ski 2 in both directions.

Hereinafter, for sake of simplicity, a preferred solution is shown, according to which the first plate 3*a* and the third plate 5*a* can be connected one another. Of course, the same kind of solution can be easily adopted for the interconnection of the second plate 3*b* and the third plate 5*b*.

Figure 2:
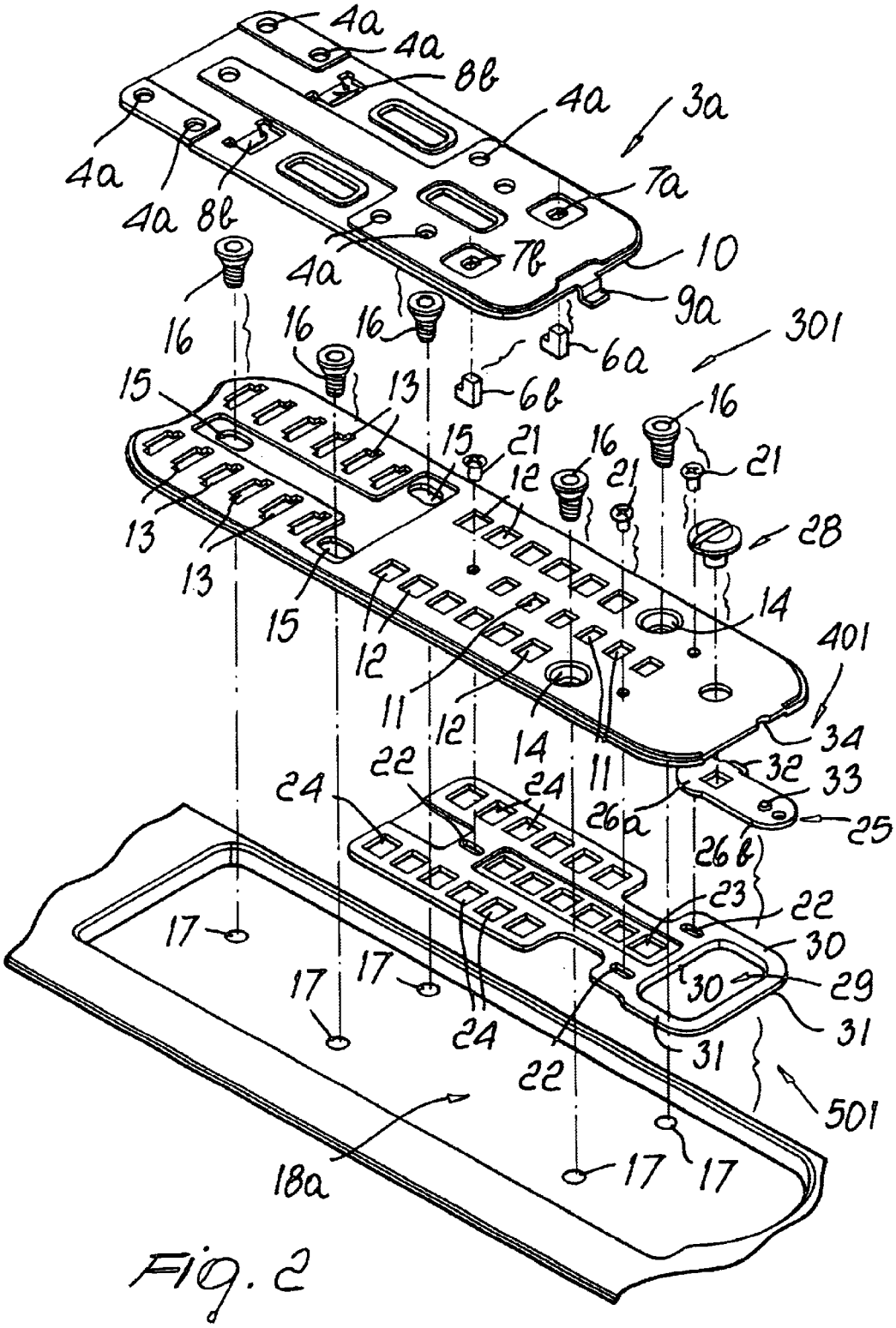
FIG. 2 is an exploded view of a detail of the device, according to the present invention.
Figures 3, 4:
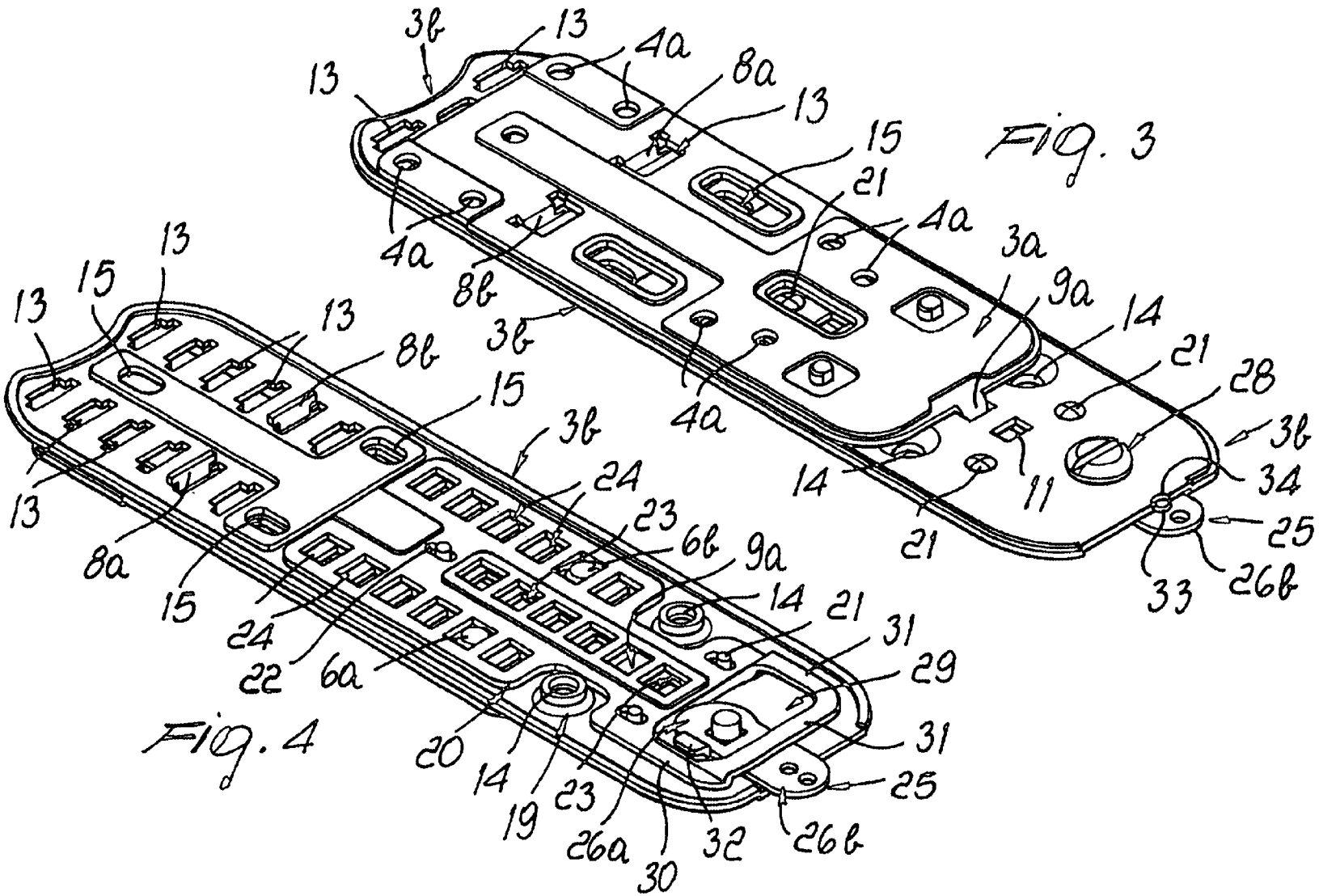
FIGS. 3 and 4 are respectively top and bottom plan views of other particular aspects of the device, according to the present invention.
Figure 5:
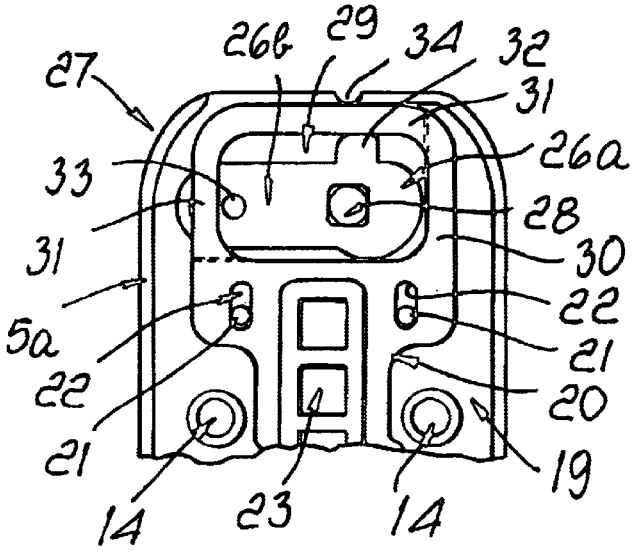
FIGS. 5 to 7 are bottom views of additional particular aspects of the device, according to the present invention.
Figure 6:
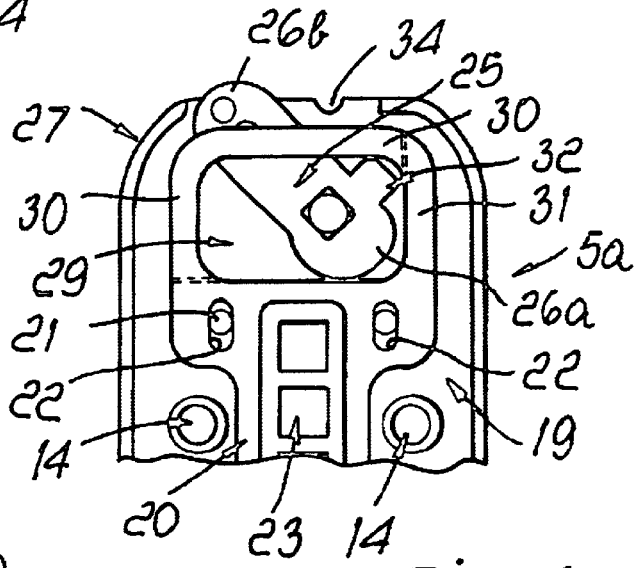
Figure 7:
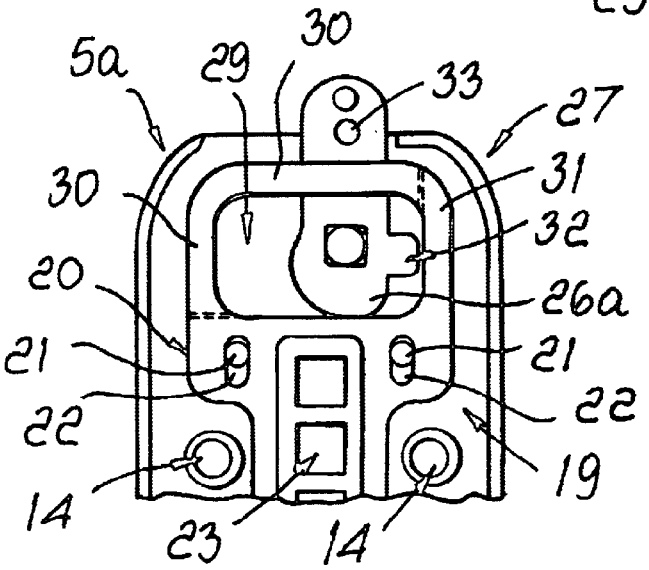

Preferably, the interconnection means 301 comprise a pair of lugs 6*a* and 6*b*, advantageously of a "L" shape or a "reverse-T" shape, suitably connected to or integral with the first plate 3*a*, for example by riveting within respective counter-shaped first seats, designated in FIG. 2 by reference numerals 7*a* and 7*b*. Advantageously, the interconnection means 301 may also comprise at least one pair of tongues 8*a* and 8*b* protruding from the bottom of the first plate 3*a*. The pair of tongues 8*a* and 8*b*, obtainable, for example, by bending, have an advantageously approximate "reverse-T" configuration. The tongues 8*a* and 8*b* are arranged approximately at the opposite end of the first plate 3*a*, with respect to a first tooth 9*a*, shaped approximately like an "L" and protruding axially from the rear edge 10 of the first plate 3*a*, to face towards a second tooth 9*b* provided symmetrically in the second plate 3*b*.

The first tooth 9*a*, the lugs 6*a* and 6*b* and the tongues 8*a* and 8*b* are advantageously designed to interact respectively with second seats 11, third seats 12 and fourth seats 13. Such seats are provided in succession axially in the third plate 5*a*. The third plate 5*a* also has transversely at least one pair of second holes 14 and at least one pair of first slots 15 designed to allow the positioning of respective first screws 16 for interconnection with third holes 17 made in the ski 2.

In particular, it is possible to arrange two first lateral slots 15 and one first slot 15 located along the median axis of said third plate 5*a*, all with axis parallel to the longitudinal median axis of the latter.

The presence of the first slots 15 allows the partial axial sliding between third plate 5*a* and ski 2, to ensure adequate flexibility of the ski 2 around the area of application of the third plate 5*a*.

In FIG. 1, it can be seen that a pair of fifth seats 18*a* and 18*b* have been provided on the upper surface of the ski 2 for positioning the interconnection device 1. These fifth seats 18*a* and 18*b*, advantageously counter-shaped approximately to the third plate 5*a* and fourth plate 5*a* and 5*b*, are not mandatory for correct operation of the device according to the invention, but allow a better protection of the same, and allow its use without necessarily requiring a lifting of the ski boot sole with respect to the snowy surface.

The interconnection means 301 between the first and third plate 3*a* and 5*a* may be selectively activated through locking means 501, which are preferably housed within a sixth seat 19, provided on the lower surface of the third plate 5*a* (or the fourth plate 5*b*).

Such locking means 501 advantageously comprise a sliding fifth plate 20, which is operatively connected to the third plate 5*a* (or the fourth plate 5*b*), for example through the positioning of three pins 21, protruding from the bottom of the third plate 5*a* and sliding within second slots 22, provided longitudinally in the fifth plate 20.

Seventh 23 and eighth 24 seats are provided in the fifth plate 20 for positioning the first tooth 9*a* and the pair of lugs 6*a* and 6*b* respectively, these seventh and eighth seat 23 and 24 being aligned with the second seats 11 and the third seats 12 and having similar shape and dimensions thereto.

The locking between the first plate 3*a* and the third plate 5*a* is accomplished through a translation of the fifth plate 20 in an axial direction towards the tip of the ski 2 and therefore in a direction moving away from the rear edge 10 of the first plate 3*a*.

FIG. 2 is an exploded view of the device of the present invention, showing that the first plate 3*a*, the third plate 5*a* and the fifth plate 20 are located one on top of the other, wherein the first plate 3*a* is the top plate, the third plate 5*a* is the middle plate and the fifth plate 20 is the bottom plate.

For actuating the axial translation of the fifth plate 20 the locking means 501 are associated to suitable adjusting means 401, which comprise preferably a second screw 28 and a flat shaped lever 25, connected thereto and having a first head 26*a*, from which a shank 26*b* projects.

The first head 26*a* of the lever 25 is pivotally connected to a first end 27 of the third plate 5*a*, advantageously by means of the second screw 28 passing axially in said third plate 5*a* in order to be connected in a non-pivotal way with the same first head 26*a*.

The first head 26*a* of the lever 25 is housed in line with an aperture 29, advantageously oval or rectangular, provided in the end of said fifth plate 20.

In this embodiment the aperture 29 is defined by a first pair of edges 30, adjacent and lying on the same plane as the lever 25, and a second pair of edges 31, adjacent and lowered with respect to that plane.

In this way the lever 25 may interact selectively with the transverse edge of the first pair of edges 30, or with the transverse edge of the second pair of edges 31, resulting in a forward or backward movement of the whole fifth plate 20.

In particular, the lever 25 is shaped in such a way as to interact with the transverse edge of the first pair of edges 30 through the outer edge of its head 26*a*, which has a suitable cam shape profile.

In the same way the lever 25 interacts with the transverse edge of the second pair of edges 31 by means of an appendage 32, which protrudes from the bottom and side of the first head 26*a*, which is arranged along the same plane as the pair of second edges 31.

By exerting a rotation on the second head 28*a* of the second screw 28, the user may control the rotation of the lever 25 so that it interacts with the fifth plate 20.

A clockwise or counter-clockwise rotation of the second screw 28 by the user therefore leads to the contact of portions between the fifth plate 20 and the appendage 32 and the profile of the first head 26*a* respectively, with consequent translation in one direction or the other of fifth plate 20.

During this translation there is contact between the outer edge of the seventh seat 23 that houses the first tooth 9*a* and of the eighth seat 24 that houses the pair of lugs 6*a* and 6*b* and the tooth and the lugs respectively, in this way causing an equal axial translation also on the first plate 3*a*.

This forced translation of the first plate 3*a* with respect to the third plate 5*a* ensures locking between the same, in that the pair of lugs 6*a* and 6*b* and the pair of tongues 8*a* and 8*b* engage with the lower edges of the third and fourth seats 12 and 13 in which they are housed, and are kept in position by way of the contact between the first head 26*a* of the lever 25 and the transverse edge of the first pair of edges 30 of the aperture 29. Advantageously, safety blocking means are provided to ensure that lever 25 remains in the locking position, which is equivalent to a position approximately parallel to the longitudinal axis of the third plate 5*a*. These blocking means comprise advantageously a boss 33, obtained on the upper surface of the shank 26*b* of the lever 25, which may be housed in a counter-shaped cutout 34 provided in the first end 27 of the third plate 5*a*.

Figure 9:
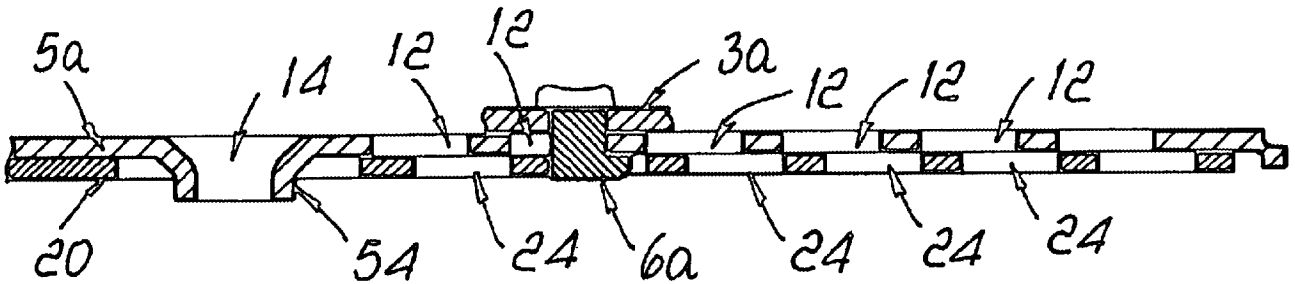
FIGS. 9 and 10 are sectional views of the embodiment of the device shown in FIG. 8.
Figure 8:
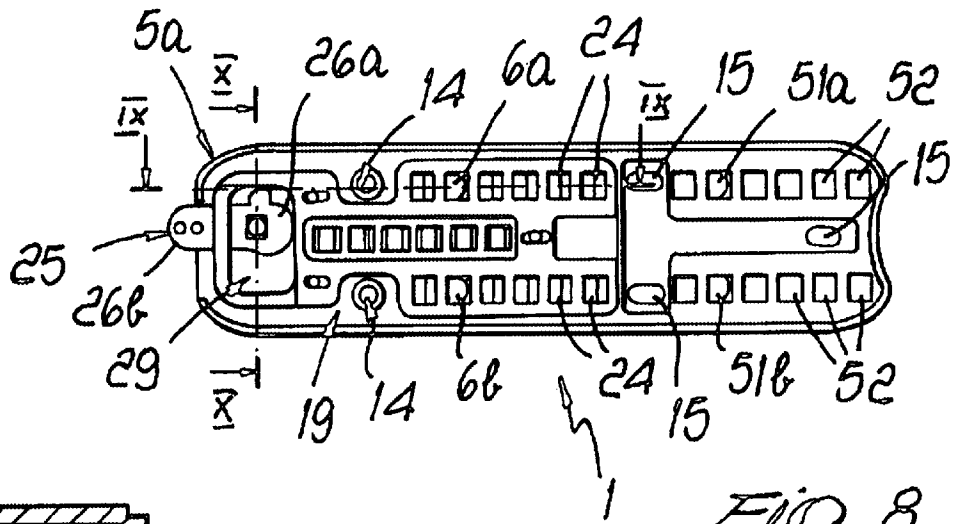
FIG. 8 is a bottom view of a second embodiment of the device, according to the present invention.

Operation of the device according to the invention is as follows: with reference to the FIG. 1, it can be seen that the ski 2 may be fitted right from the production stage with a pair of mechanisms formed by said third, fourth, fifth plates, suitably housed in possible seats 18*a* and 18*b* previously made while manufacturing the ski. The third and fourth plate 5*a* and 5*b* are suitably connected to the ski through the first screws 16, housed in corresponding third holes 17 previously made during the manufacture of the ski. Similarly the first and second plate 3*a* and 3*b* are connected to the toe unit and to the heel unit respectively of a ski binding and may therefore, if necessary, be marketed and sold separately from the other components described above. To accomplish the interconnection, for example, of the toe unit to the ski 2, it is sufficient to position the first tooth 9*a* in one of the second seats 11 provided in succession along the third plate 5*a*, then turn the toe unit until the first plate rests on top of the third plate. The second screw 28 is then rotated, which in turn rotates the lever 25 from an oblique or approximately transverse position to a position approximately parallel to the longitudinal axis of the ski (see FIG. 7), causing the first and fifth plates 5*a* and 20 to translate, and thereby ensuring the locking of said pairs of lugs and tongues 6*a*, 6*b*, 8*a* and 8*b* to the lower edges of the respective third and fourth seats 12 and 13, as shown in the detail of FIG. 9. The interconnection of the heel unit to the ski is accomplished in a completely similar way. Positioning of the toe unit and the heel unit along the ski and therefore also the size (i.e. the distance between said toe and heel units) and position of the centre of gravity during skiing are determined with respect to the second, third and fourth seats 11, 12 and 13 selected for positioning of the tooth, lugs and tongues.

It has thus been shown that the invention has achieved the established aim and objects, a device for the interconnection of a ski binding to a ski having been devised that allows the toe unit and the heel unit to be quickly and simply interconnected to the ski separately and independently of each other. Being connectable to the ski in several different positions, the toe unit and the heel unit not only allow an excellent adjustment of the size of the ski binding, but also shifting of the centre of gravity along the ski according to the type of skiing desired by the user. The toe unit and the heel unit being separate, the device according to the invention ensures excellent flexibility around the central area of the ski; at the same time it ensures a sturdy, rigid interconnection of toe unit and heel unit to the ski proper.

The possibility of easily removing the toe unit and the heel unit from the third and fourth plate allows transport thereof quite simply and easily, especially in the case of transportation by car or airplane. At the same time ski hire service is facilitated, since store management is simplified and purchasing and maintenance costs of the stock of available skis and bindings are considerably reduced. Mounting and fixing of the bindings on the ski is simple, quick, foolproof and can be done by the user, since the holes for the fixing are made during production and the subsequent adjustment is simple and intuitive.

The invention is naturally susceptible to many changes and variations, all falling within the scope of the same inventive concept.

For example, the shape and positioning of the plates on the ski can be reversed and, therefore, the teeth 9*a* and 9*b* can also not be facing each other but projecting from opposite sides.

In the same way the interconnection means 301 may comprise elements of different shape and other type than that described, and it is possible to use without distinction just several pairs of "T" shape tongues or just several pairs of "L" shape lugs, or even other shape hooks, tongues or lugs, provided they ensure an effective interconnection to the third plate and fourth plate once they touch the edge of the respective seats.

In FIGS. 8–11, a second embodiment is shown in which the same reference numeral designate the same elements.

In these figures it can be seen that such different embodiment comprises a first plate 3*a*, with first seats 7*a* and 7*b* in the area near the first tooth 9*a*, and separate and similar seats 50*a* and 50*b*, provided in an approximately opposite position to the median transversal axis of the same first plate 3*a*. The separate seats 50*a* and 50*b* are designed for positioning and interconnection, for example by riveting, of a second pair of lugs 51*a* and 51*b*, advantageously shaped like the pair of lugs 6*a* and 6*b* that may be positioned in said first seats 7*a* and 7*b*. Also this second pair of lugs 51*a* and 51*b* has an approximately "L" or "reverse T" shape, in order to be able to connect with the lower edge of the pairs of apertures 52, provided in the third plate 5*a* in the position of the fourth seats 13. These pairs of apertures 52 have advantageously similar shape and dimensions with respect to the third seats 12 for said pair of lugs 6*a* and 6*b*.

Figure 10:
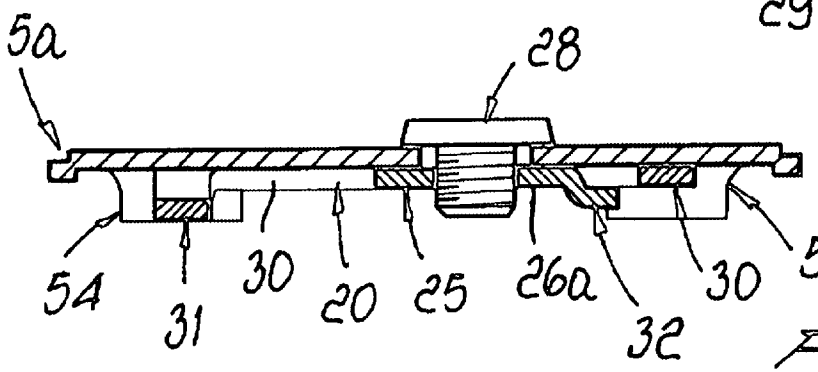
Figure 11:
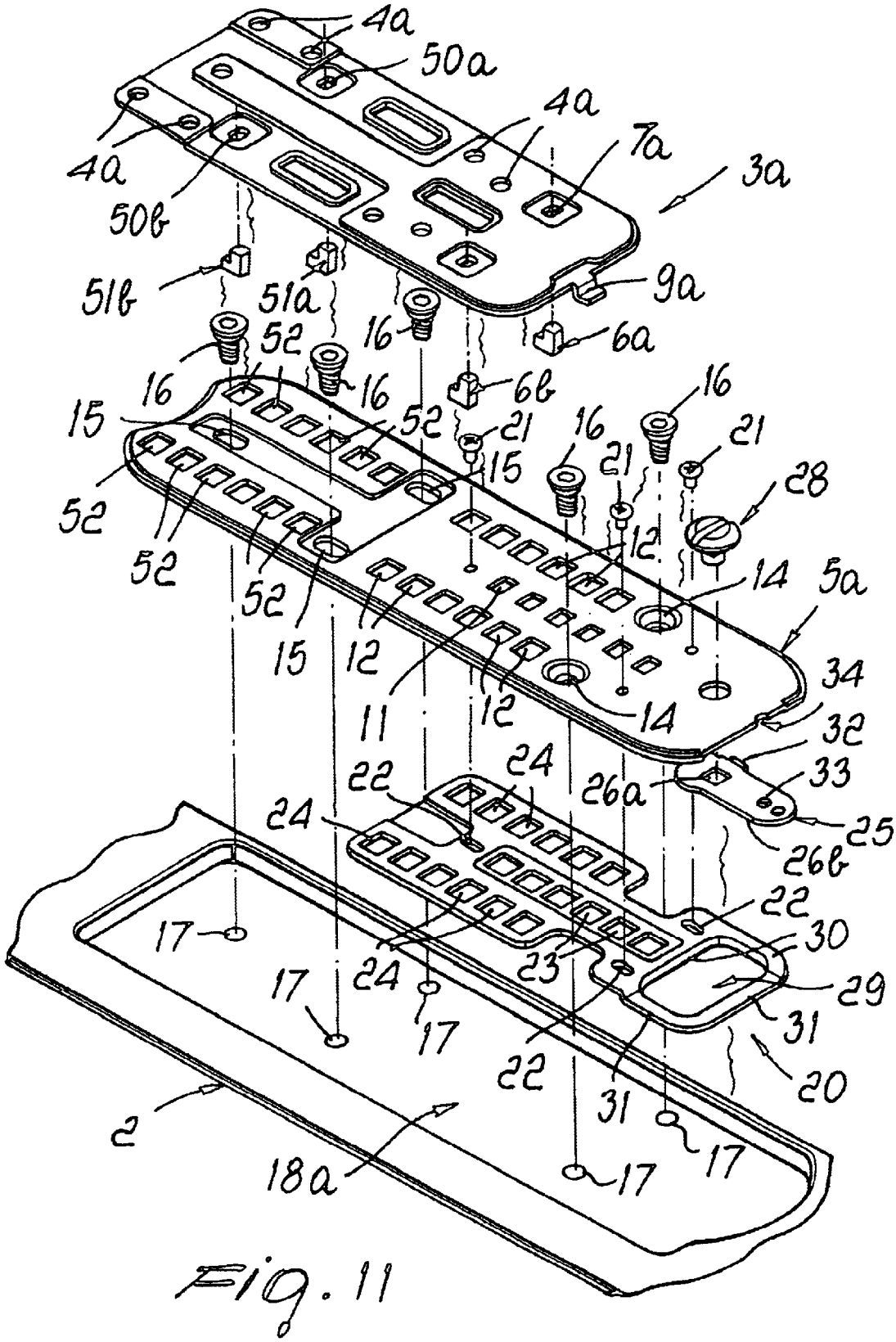
FIG. 11 is an exploded view of the embodiment of the device shown in FIG. 8.

In FIG. 10 it can also be seen that the second pair of lowered edges 31 of said fifth plate 20 protrudes from the bottom of the outer edge, designated by reference numeral 53, of the third plate 5*a*.

In order to allow free movement of the lever 25 and therefore to avoid contact between the same and the upper surface of the fifth seat 18*a*, seams 54 are provided around the edge and below the second holes 14, having a depth greater than the thickness of the fifth plate 20.

Also the locking means and the adjusting means may comprise elements of different shape from those described, provided they ensure excellent operation of the device.

The materials, so long as they are compatible with the contingent use, as well as the dimensions, may be any according to requirements.

The disclosures in Italian Patent Application No. TV2001A000147 from which this application claims priority are incorporated herein by reference.

What is claimed is:

1. A device for the interconnection of a ski binding to a ski, comprising a top plate for interconnecting to said ski a binding unit such that a toe unit or a heel unit of said ski binding, said top plate being movably associated at a bottom to a middle plate which is associated longitudinally to said ski, temporary interconnection means being arranged between said top plate and said middle plate, said interconnection means being selectively activated through locking means operable by the user, said locking means comprising at least a bottom sliding plate that is operatively connected to said middle plate in an approximately axial direction, said bottom plate being suitable to perform a translation in an axial direction and to interact with said interaction means in order to lock said top plate and said middle plate by means of the interaction between said bottom plate and said interconnection means.

2. The device according to claim 1, wherein said top plate is associated to said middle plate, according to a plurality of prefixed positions obtained in succession along a longitudinal axis of said ski.

3. The device according to claim 1 wherein said temporary interconnection means further comprise at least one pair of lugs, connected to or made integral with a lower surface of said top plate to protrude towards said top plate.

4. The device according to any of the preceding claims, wherein the top plate and the middle plate forming a toe unit are arranged along said ski in an approximately mirror-like position with respect to the top plate and the middle plate forming a heel unit, so as to ensure interchangeability between said toe unit and said heel unit.

5. The device according to any of the preceding claims, wherein said middle plate is at least partially housed in a fifth seat that is provided longitudinally to said ski, approximately at a central portion of said ski.

6. The device according to any of the preceding claims, wherein said locking means are housed in a sixth seat provided on a lower surface of said middle plate.

7. The device according to any of the preceding claims, further comprising a plurality of pins protruding from a bottom of said middle plate and sliding within respective second slots obtained longitudinally in said bottom plate.

8. The device according to any of the preceding claims, further comprising adjustment means for adjusting axial translation of said bottom plate, said adjusting means being activated independently and manually by the user.

9. The device according to claim 8, wherein each of said adjusting means comprise a lever pivotally attached at the bottom of said middle plate.

10. The device according to claim 9, further comprising safety blocking means for locking said lever in a locking position.

* * * * *